US005683650A

United States Patent [19]

Morando

[11] Patent Number: 5,683,650

[45] Date of Patent: Nov. 4, 1997

[54] BUBBLE APPARATUS FOR REMOVING AND DILUTING DROSS IN A STEEL TREATING BATH

[76] Inventor: Jorge A. Morando, 220 W. Jefferson Ave., Trenton, Mich. 48183

[21] Appl. No.: 489,322

[22] Filed: Jun. 12, 1995

[51] Int. Cl.[6] ..... C21D 1/62

[52] U.S. Cl. ..... 266/44; 266/112; 266/133; 266/227

[58] Field of Search ..... 266/112, 130, 266/133, 227, 280, 44; 118/422

[56] References Cited

U.S. PATENT DOCUMENTS

| | | | |
|---|---|---|---|
| 2,074,498 | 3/1937 | Wean | 266/227 |
| 2,166,250 | 7/1939 | Herman | 118/422 |
| 3,914,481 | 10/1975 | Bostroem | 118/422 |
| 5,084,094 | 1/1992 | Fracois et al. | 266/227 |
| 5,203,910 | 4/1993 | Areaux et al. | 75/708 |

*Primary Examiner*—Scott Kastler

*Attorney, Agent, or Firm*—Charles W. Chandler

[57] ABSTRACT

A bubble-actuated pump is used for removing dross from the surface of a bath of molten metal. A modification of the pump is employed for delivering molten metal to the dross for diluting it.

11 Claims, 5 Drawing Sheets

BUBBLE APPARATUS FOR REMOVING AND DILUTING DROSS IN A STEEL TREATING BATH

BACKGROUND OF THE INVENTION

Compressed gasses have been utilized for transferring fluids for many decades. Steam under high pressure has been injected into inaccessible oil deposits under the earth to force it to the surface. For nearly five decades and perhaps before that compressed helium or nitrogen has been injected into the fuel tanks of aerospace vehicles to displace the propellants from the tanks into the injector nozzles. Bubbling air in ponds for circulating and aerating (oxygenating) the water is a procedure well over a century old. A similar process of injecting compressed air through an inclined tube is used in ships' drinking water tanks, fish tanks and aquariums today for identical purposes. The gas is supplied by a gas pump or bubble pump. U.S. Pat. No. 5,203,910 issued to Larry Areaux and Brian Klenoski on Apr. 20, 1993, utilizes the bubble pump method for inducing a flow of molten metal in a conduit for its recirculation in a furnace.

This particular invention pertains to a bubble-operated pump for removing or diluting dross from the surface of a bath of molten metal. In steel strip galvanizing, such a molten metal bath surface is contained within an inert gas filled snout that encloses the steel strip being introduced into the bath.

Steel utilized in the automotive, construction and appliance industries and the like is formed in very thin strips (0.015 to 0.060 inch thick), which is then passed through a molten bath of either aluminum (aluminizing), zinc (galvanizing) or aluminum/zinc (galvalume). The strip width usually ranges from 30 to 70 inches. To avoid the formation of oxides on the strip's surface that are detrimental to the coating quality, the strip is delivered to the molten bath from a nitrogen/hydrogen-filled furnace through a tubular housing (snout), also filled with the same gas (see FIG. 1 ). Because of the extremely large dimensions of the equipment required and in spite of efforts to prevent air leaks into the furnace, small air leaks occur, generating ferrous oxides ($Fe_2O_3$, FeO, etc.).

When the steel strip enters the bath, a chemical process occurs in which the aluminum or zinc in the bath reacts with the iron oxides to form dross, aluminum oxides ($Al_2O_3$) and/or zinc oxides (ZnO). In other words, $$2Al+Fe_2O_3=Al_2O_3+2Fe$$

$$3Zn+Fe_2O_3=3ZnO+2Fe$$

The free iron released settles to the bottom of the molten metal pot. On the other hand, because of their slightly lower density to the molten metal, the alumina ($Al_2O_3$) and zinc oxide (ZnO) remain in suspension or float to the surface. The dross accumulated in the area enclosed by the snout is a very hard ceramic and usually contains large particulate that adheres to the steel strip being processed creating a defective coating, poor appearance and high rejection rates.

The present approach to remove such dross, because of its inaccessibility, is to: 1) stop the line, 2) vent the furnace and snout areas of their inert gas, 3) lift the snout, and 4) clean the area by raking the dross off the bath's surface which is obviously a very time-consuming, expensive and production-affecting procedure.

A conventional motorized pump having mechanical parts exposed to molten metal and forcing hard ceramic-based dross through its propellers and bearings has an expensive maintenance problem coupled with a short life.

SUMMARY OF THE INVENTION

I have experimented with a different approach for removing the dross by pumping it through a snorkel-shaped conduit having its inlet placed inside the tubular snout.

The broad purpose of the present invention is to provide a reliable and inexpensive pump for removing dross from the surface of a molten metal bath enclosed in a delivery snout.

Another object of the invention is to provide a bubble-type pump having no moving parts for removing dross from an enclosed snout in a molten metal bath.

Still another object of the invention is to provide a bubble-type pump having no moving parts for delivering molten metal into the dross area in an enclosed gas-filled snout to dilute the dross concentration.

In the preferred embodiment of the invention, both the dross dilution pump and the dross removal pump comprise a tubular conduit having an inlet side for receiving molten metal and an outlet side for discharging the metal. A source of an inert gas such as nitrogen (or argon) is connected in the outlet side of the conduit. As the nitrogen bubbles upwards toward the surface, it creates a suction effect in the inlet side of the conduit generating a flow of metal in the same direction.

When the pump is used for dross removal, the inlet side is disposed with its entrance adjacent the dross level of the bath inside the gas-filled snout, the outlet side being disposed outside the snout. When the pump is used as a dross diluent, the inlet side is disposed beneath the surface of the bath outside the snout, with its outlet side disposed closely adjacent the dross.

Still further objects and advantages of the invention will be apparent to those skilled in the art to which the invention pertains upon reference to the following detailed description.

BRIEF DESCRIPTION OF THE DRAWINGS

The description refers to the accompanying drawings in which like reference characters refer to like parts throughout the several views and in which.

DESCRIPTION OF THE PREFERRED EMBODIMENT

Figure 1:
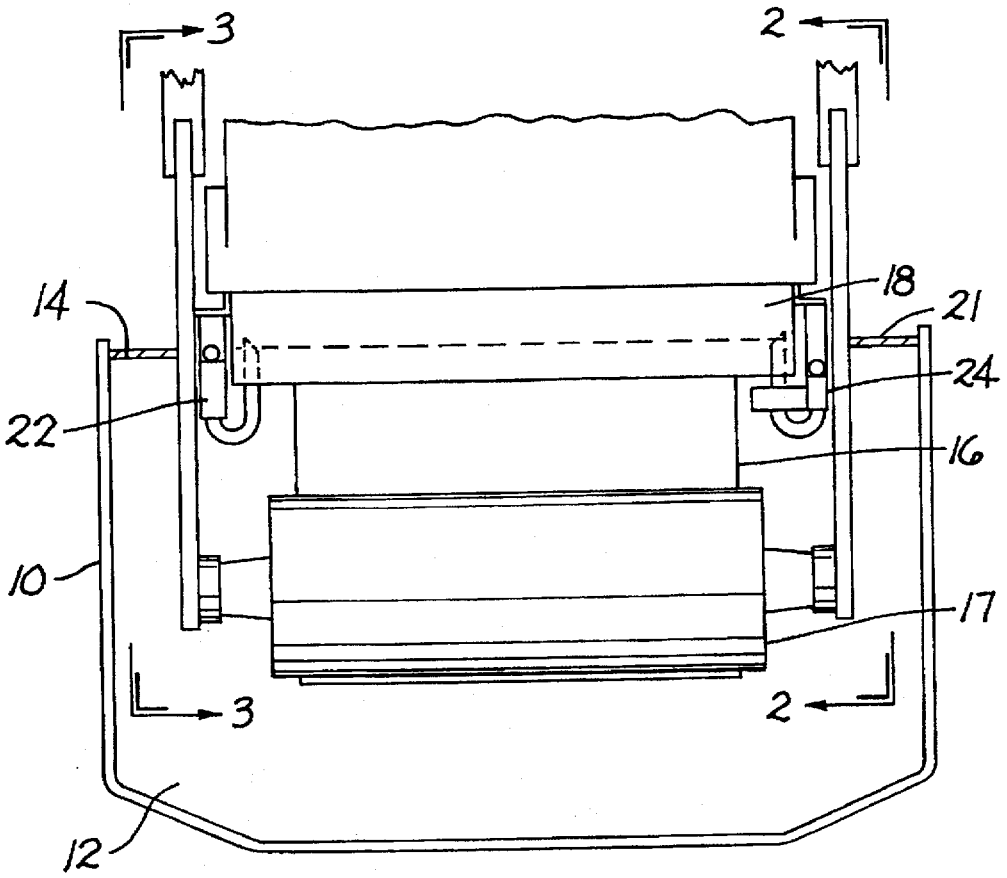
FIG. 1 is a schematic sectional view through a molten metal bath showing a dross removal pump and a dross diluting pump illustrating the invention.
Figure 2:
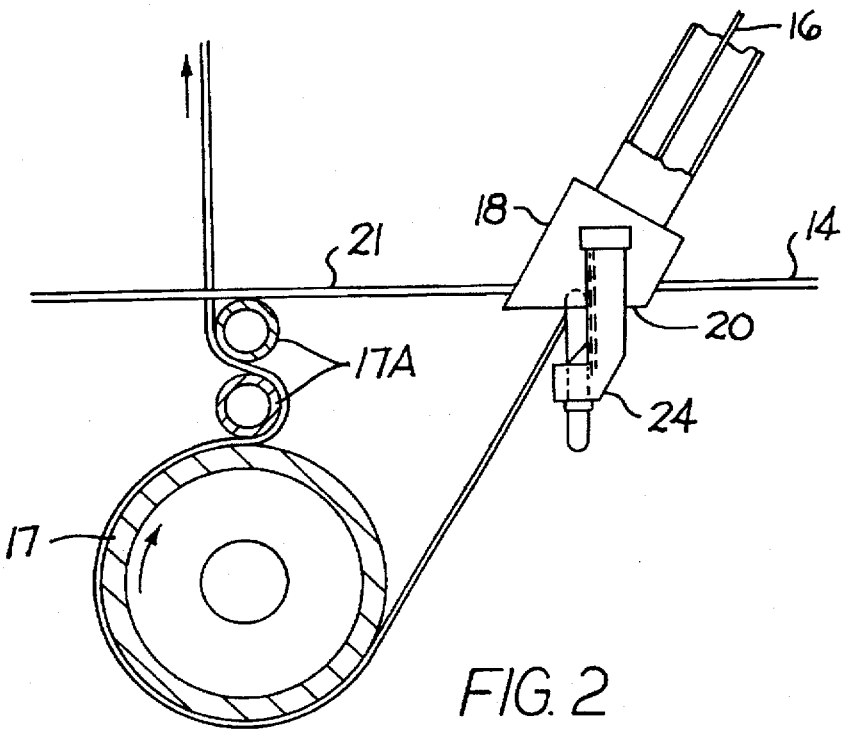
FIG. 2 is an enlarged sectional view as seen along lines 2—2 of FIG. 1.
Figure 3:
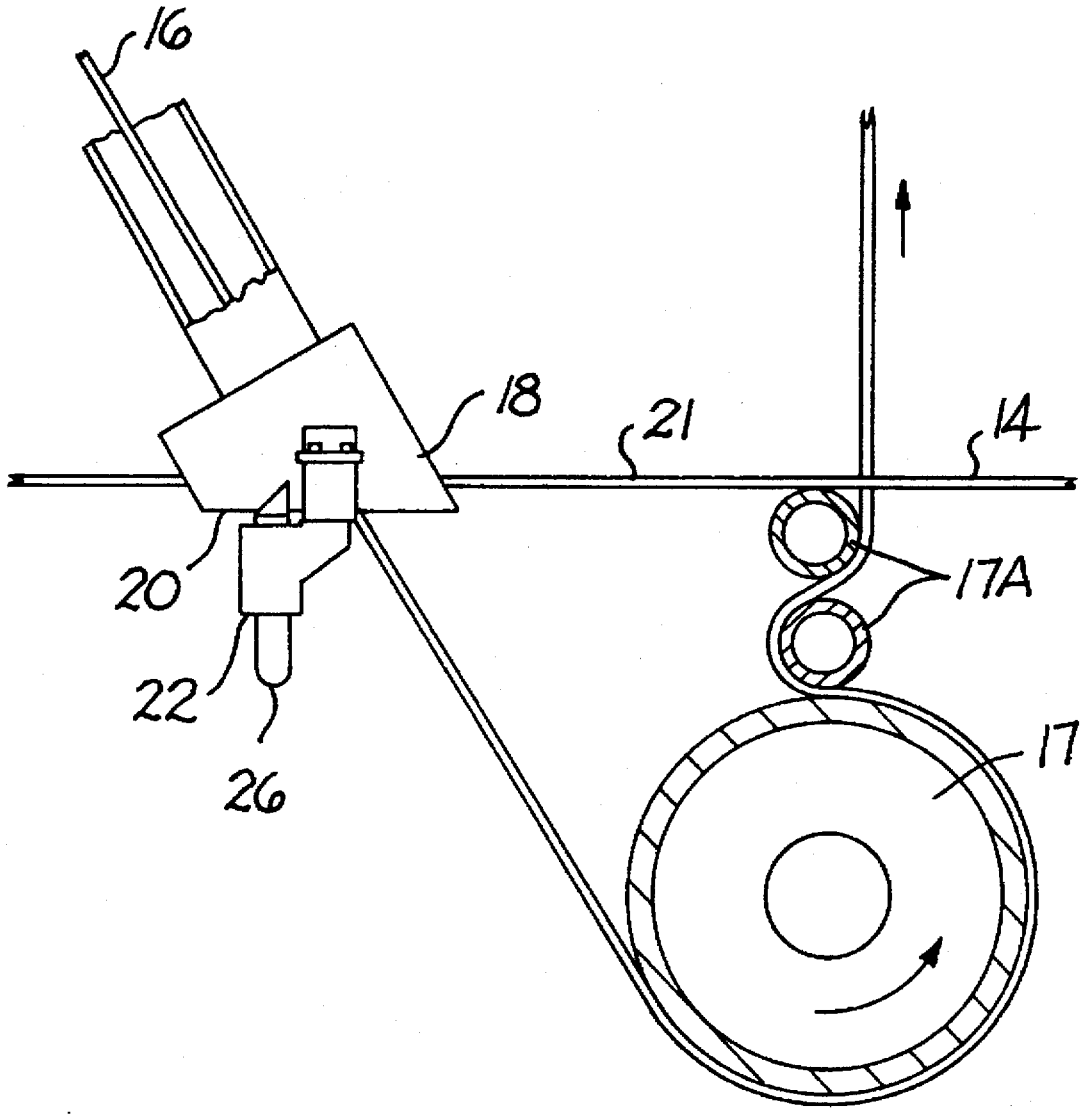
FIG. 3 is an enlarged sectional view as seen along lines 3—3 of FIG. 1, illustrating the dross removal pump location.

Referring to the drawings, FIG. 1 illustrates a conventional heated metal pot 10, which for illustrative purposes, contains a bath of molten aluminum 12. The bath has a top surface 14, usually referred to as the molten metal line. A continuous moving strip of low carbon steel 16 is introduced into the bath from a furnace (not shown) in the conventional manner as illustrated in FIG. 3. The strip passes around a sink roll 17 and tensor rolls 17A, while submerged in the bath, so that the surface of the strip picks up an aluminum coating.

Strip 16 is delivered to the bath through a conventional tubular snout housing 18. The interior of the housing contains an inert gas such as nitrogen or a mix of nitrogen and hydrogen which, as is well known to those skilled in the art, is useful in preventing the steel strip from oxidizing. Oxidation damages the coating being applied.

The lower exit opening 20 of the snout housing is disposed 6–12 inches below top surface 14 of the bath in order to assure a sealed area for the inert gas filling the furnace and the snout. The steel strip enters the bath through lower opening 20 of the snout, submerged into the metal by the rotating rolls as shown in FIG. 3. The strip emerges from the bath and passes on to air knives (not shown) which remove excess coating metal, and then passes to its next destination.

The chemical reaction occurring between the steel strip, the steel strip oxides and the aluminum bath creates a dross layer 21 that accumulates at surface 14 inside the snout housing. An inert gas bubble-operated dross removal pump means 22 removes dross from layer 21. A second inert gas-operated bubble pump means 24 delivers molten aluminum to the dross layer inside the snout housing to dilute the dross.

Figure 4:
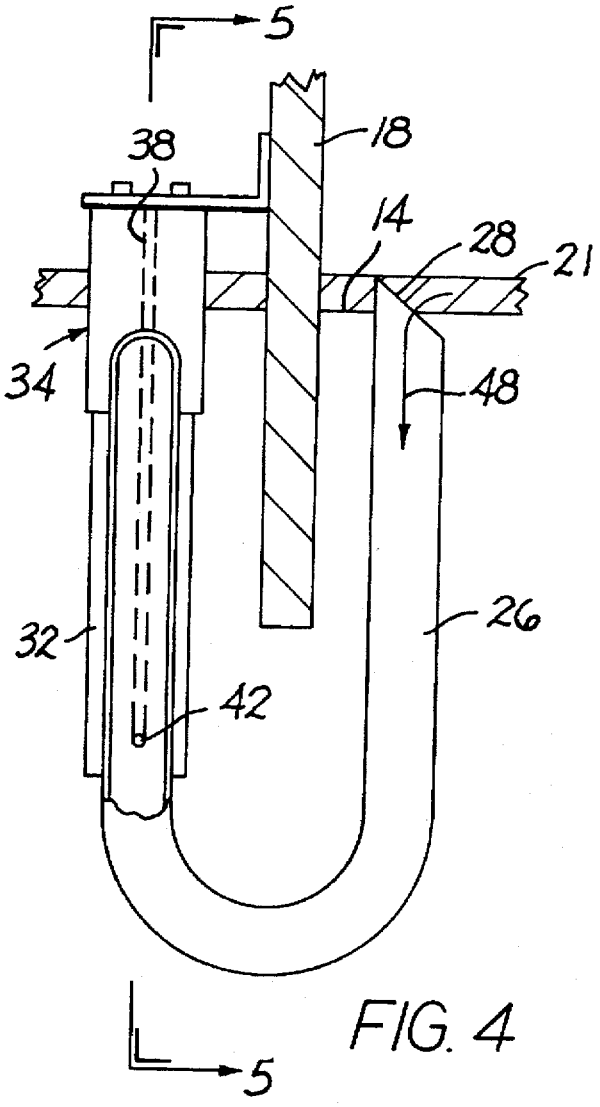
FIG. 4 is a more detailed sectional view of the dross removal pump.
Figure 5:
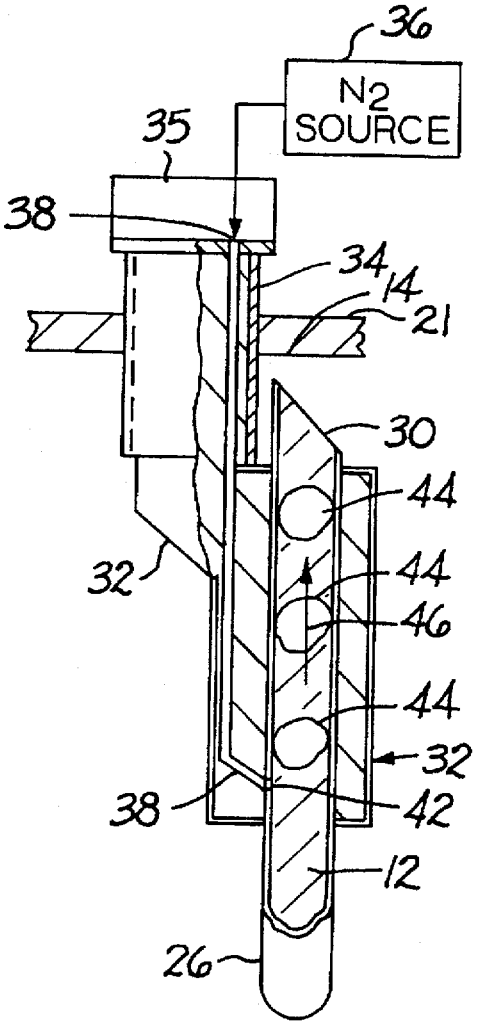
FIG. 5 is a view as seen as seen along lines 5—5 of FIG. 4.
Figure 6:
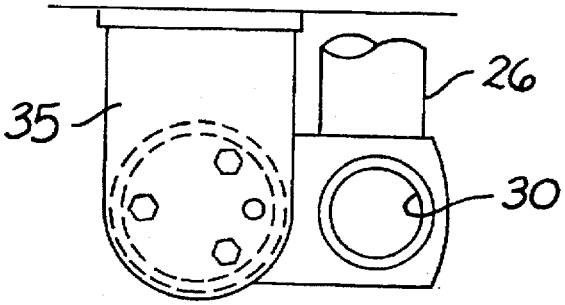
FIG. 6 is an enlarged view as seen from the top of FIG. 5.

Referring to FIGS. 3–5, the dross removal pump has a generally U-shaped tubular conduit 26. The tubular conduit can be manufactured from different materials, depending on the particular molten metal bath in which it is being utilized. In a zinc galvanizing bath, tubular conduit 26 can be manufactured from stainless steel material or AT-103 or AT-103A, a metallic super alloy material available from ALPHATECH, INC. of Trenton, Mich., specially formulated for resistance to zinc at temperatures up to 1400° F. In galvalume (aluminum and zinc) or aluminum, conduit 26 can be manufactured from any ceramic material resistant to these molten metals, or RBSN-AL25, a ceramic material also available from ALPHATECH, that has proved to be extremely resistant to molten aluminum attack at temperatures up to 1600° F. and capable of withstanding up to 5000 thermal shocks from air to molten aluminum at 1480° F.

The diameter of conduit 26 depends upon the amount of dross flow expected to be removed by the pump. For most existing galvanizing and aluminizing lines, a tube diameter of 2.5 to 3 inches should be sufficient.

The conduit has an upper inlet opening 28 formed at an angle of 45°–60° with respect to the vertical leg of the conduit and supported in dross layer 21 of the bath. Conduit 26 has an outlet opening 30, also formed at an angle of 45°–60° with respect to the longitudinal axis of the vertical leg of the conduit as shown in FIG. 5. Opening 30 is disposed 2 to 6 inches below the dross layer 21. Inlet opening 28 and outlet opening 30 face upwardly.

A pump body 32, in this particular application for molten aluminum, is manufactured from a graphite material with its upper portion housed in a ceramic outer layer 34 to prevent air burning of the graphite in the portion of the housing above the metal line. Pump body 32 is connected to a suitable external support 35.

A source of inert gas 36 such as nitrogen, delivers the gas through a vertical conduit 38 located inside pump body 32 to an opening 42 in conduit 26. Opening 42 is preferably placed 14 to 16 inches below outlet opening 30. In applications where severe dross conditions exist requiring additional suction forces, the depth of opening 42 can be increased to obtain the desired results.

The gas can be delivered either in a continuous or an intermittent form. In either case, the gas emerges from opening 42, and forms a series of spaced bubbles 44 because of surface tension. The bubbles rise in the molten aluminum. The rising bubbles entrap sections of molten aluminum between them and carry them upwardly in the direction of arrow 46.

Figure 10:
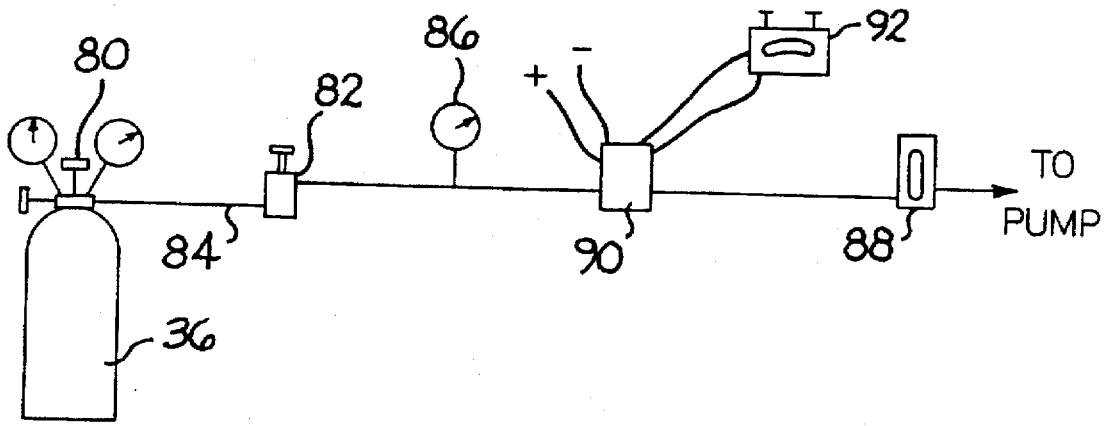
FIG. 10 illustrates an inert gas delivery system schematic for a pulsating gas flow arrangement.

By applying an intermittent flow of gas as shown in FIG. 10, the utilization of the gas can be optimized by adjusting the frequency of the bubbles' formation and expansion rate to match the particular application. The rising bubbles induce a flow of molten metal towards outlet opening 30, generating a suction at inlet opening 28 which causes the dross located on the surface of the bath to move in the direction of arrow 48 into the inlet opening. A flow is created into conduit 26, thereby scavenging the dross from inside snout housing 18 to a location outside the housing where it can be skimmed off or removed by conventional means.

As can be seen from the description, the pump apparatus involves no moving parts exposed to the molten metal.

Figure 7:
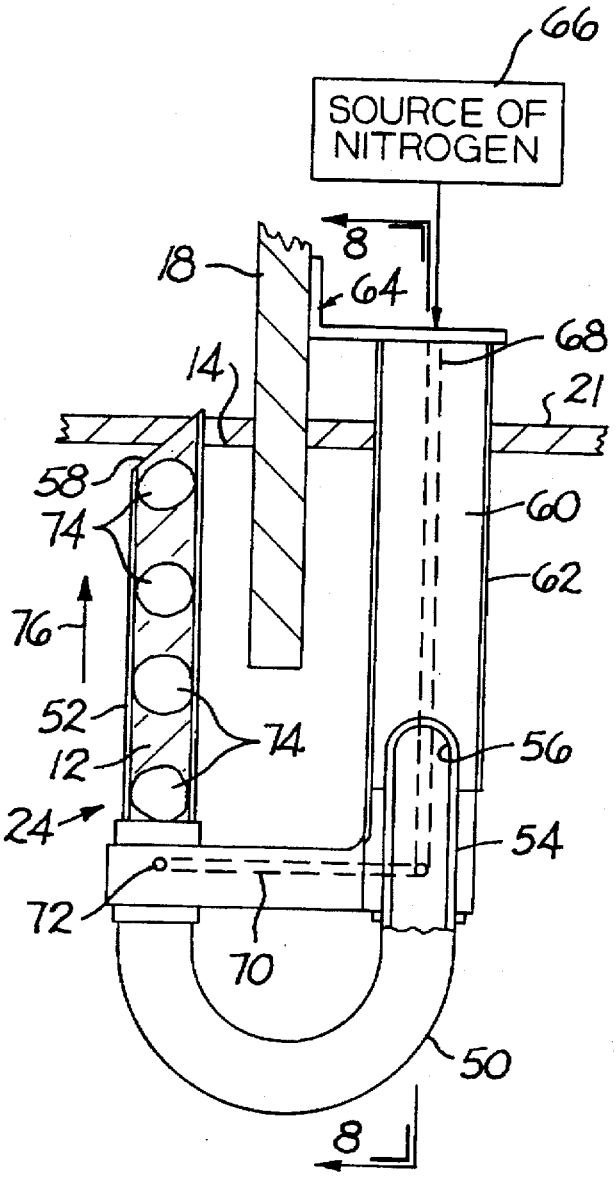
FIG. 7 is a view of the dross diluting pump.
Figure 8:
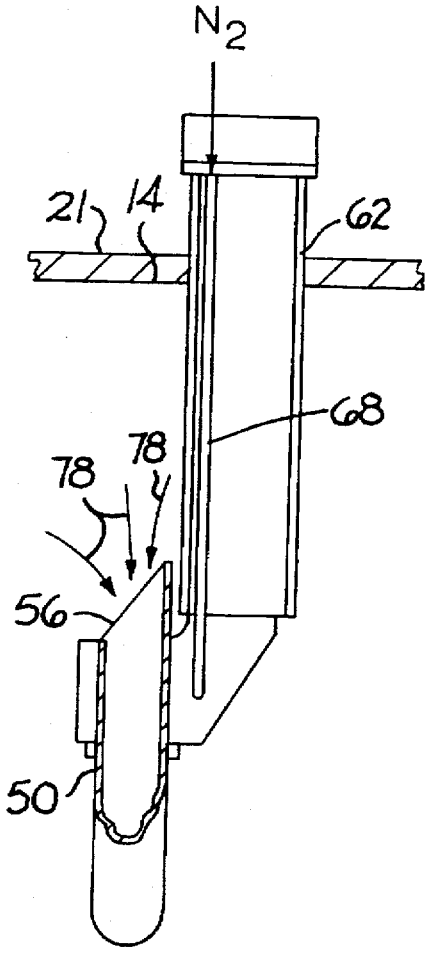
FIG. 8 is a view as seen from the right side of FIG. 7.

Referring to FIGS. 7 and 8, dross dilution pump means 24 is similar in structure and operation to the dross removal pump, comprising also a U-shaped conduit 50 having a pair of vertical arms 52 and 54 terminating with lower inlet opening 56 and upper outlet opening 58. The two openings are formed at an angle of about 45° with respect to the longitudinal axis of their respective legs. Inlet opening 56 is disposed 12 to 14 inches below the level of the bath while outlet opening 58 is disposed adjacent the dross layer inside snout housing 18.

Conduit 50 is formed of ceramic for use in an aluminum or galvalume bath and has a diameter of about 2.5 to 3 inches. Inlet opening 56 is disposed about 14 to 16 inches below outlet opening 58 and located outside housing 18. Conduit 50 is supported by a graphite or ceramic housing 60 having, in the case of graphite, a ceramic exterior shield 62 mounted on a suitable frame means 64, so that both the inlet and outlet openings face upwardly. The entire assembly is attached to the exterior face of the snout housing to assure its relative vertical and horizontal positions.

A source of nitrogen 66 (or any other inert gas such as argon or helium) is connected to a conduit passage 68 located in the pump housing which passes downwardly and then across a horizontal conduit leg 70 to an opening 72 in the lower part of arm 52, beneath outlet opening 58. The nitrogen is delivered in either a continuous or an intermittent form (depending on the degree of flow control desired) to form a series of spaced bubbles 74 which rise toward outlet opening 58 in the direction of arrow 76. The rising bubbles induce a flow of relatively uncontaminated molten aluminum 12 through inlet opening 56 in the direction of arrows 78. Thus, a substantially continuous flow of aluminum is delivered inside the snout housing, diluting the dross and thereby minimizing not only the amount but the particulate size of the dross formed around moving strip of steel 16. In addition, the uncontaminated aluminum flow assists the dross removal pump in scavenging the dross from inside the snout housing.

Figure 9:
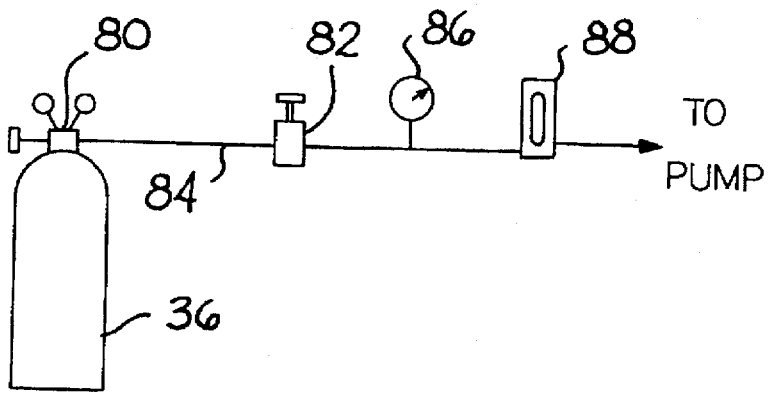
FIG. 9 illustrates an inert gas delivery system schematic for a continuous gas flow arrangement.

FIG. 9 shows a means for modulating the pressure of the inert gas being received from source 36, a compressed gas tank. The gas may be either gaseous or liquid nitrogen, argon or helium. A coarse pressure regulator 80 is mounted on the tank for regulating a pressure down from a range of 3000/2000 p.s.i. to 200± p.s.i. Regulator 82 is in conduit 84 which delivers the gas from source 36 to the pump. Regulator 82 is a fine adjusting pressure regulator for regulating pressure down from 200±100 to 30 p.s.i. ±10 p.s.i.

Pressure gauge 86 is connected in the conduit for measuring the pressure and reads from 0 to 100 p.s.i.

Gas flow meter 88 is connected in the conduit 84 for controlling the gas flow from 0 to 100 cfh. Higher gas flows may be required for larger conduit 26 diameter.

FIG. 10 illustrates a control system similar to FIG. 9, but in which a solenoid valve 90 is mounted in the conduit with an ON/OFF timing device 92 for providing an intermittent charge of gas and which can be regulated between 0 to 2 seconds between charges.

For illustrative purposes almost 25,000 pounds per hour of dross may be removed from the pot using 40 standard cubic feet per hour of nitrogen at 15 to 25 p.s.i.

Having described my invention, I claim:

1. In a metal treating apparatus having a container for holding a bath of molten metal, a gas-filled housing for enclosing a moving strip of metal, the housing having an opening in said bath of molten metal below the level thereof, through which the strip of metal exits the housing while submerged in the molten bath of metal, apparatus for removing a layer of dross from the surface of the metal bath inside the gas-filled housing, comprising:

a conduit having an inlet opening and means supporting the inlet opening adjacent the surface of the molten metal for receiving dross into the conduit;

the conduit having an outlet opening for discharging dross received through said inlet opening;

the conduit having a gas-receiving opening below the outlet opening; and means for introducing a gas in the gas-receiving opening which rises in said conduit to induce a flow of dross into said inlet opening and towards said outlet opening.

2. Apparatus as defined in claim 1, including means for supporting the outlet opening below the surface of the metal in the bath.

3. Apparatus as defined in claim 1, including means for diluting the dross by delivering molten metal from below the surface of the bath to the dross layer in said gas-filled housing.

4. Apparatus as defined in claim 1, including means for introducing the gas intermittently into the conduit to form a series of spaced rising bubbles which entrap and move sections of molten metal.

5. Apparatus as defined in claim 1, including means for introducing the gas continuously into the conduit to form a series of spaced rising bubbles which entrap and move sections of molten metal.

6. In a metal apparatus having a container for holding a bath of molten metal, a gas-filled housing for enclosing a moving strip of metal, the housing having an opening in said bath of molten metal below the surface thereof, through which the strip of metal exits the housing while submerged in the bath of molten metal, apparatus for diluting a layer of dross on the surface of the metal bath inside the gas-filled housing comprising:

a conduit having an inlet opening disposed in the bath of molten metal for receiving metal therein from the bath;

the conduit having an outlet opening for discharging metal received through the inlet opening to a location adjacent the layer of dross inside the gas-filled housing;

the conduit having a gas-receiving opening below the outlet opening; and means for introducing a gas which tends to rise in said molten metal into said gas receiving opening to induce a flow of molten metal into said inlet opening and to said outlet opening and the layer of dross as the gas rises in said conduit.

7. Apparatus as defined in claim 6, including means for introducing the gas intermittently into the conduit to form a series a spaced rising bubbles which entrap sections of molten metal.

8. Apparatus as defined in claim 6, including means for introducing the gas continuously into the conduit to form a series of spaced rising bubbles which entrap sections of molten metal.

9. In a metal treating apparatus having a container for holding a bath of molten metal, a gas-filled housing for enclosing a moving strip of metal, the housing having an opening in said bath of molten metal below the surface thereof, through which the strip of metal exits the housing submerged in the molten bath of metal, first apparatus for removing a layer of dross from the surface of the metal bath inside the gas-filled housing, comprising:

a first conduit having an inlet opening disposed in the housing adjacent the layer of dross for receiving dross into the first conduit;

the first conduit having an outlet opening for discharging dross received through said inlet opening;

the first conduit having a first gas-receiving opening below the outlet opening thereof;

means for introducing a gas which tends to rise in said molten metal, into said first gas-receiving opening to induce a flow of dross into said inlet opening and towards said outlet opening as the gas rises in said first conduit; and second apparatus for diluting the layer of dross on the surface of the metal bath inside the gas-filled enclosure comprising:

a second conduit having an inlet opening disposed in the bath of molten metal for receiving metal therein from the bath;

the second conduit having an outlet opening for discharging metal received through the inlet opening to a location adjacent the layer of dross inside the gas-filled housing;

the second conduit having a second gas-receiving opening below the outlet opening thereof; and means for introducing a gas which tends to rise in said molten metal into said second gas-receiving opening to induce a flow of molten metal into the inlet opening of the second conduit and toward the outlet opening thereof as the gas rises in the second conduit.

10. In a metal treating process in which a moving strip of metal passes through a bath of molten metal and a gas-filled housing which encloses the moving strip metal, the housing having an opening in said bath of molten metal below the level thereof, through which the strip of metal exits the housing while submerged in the molten bath of metal, a method for removing a layer of dross from the surface of the metal bath inside the gas-filled housing, comprising:

supporting a conduit having an inlet opening adjacent the surface of the molten metal for receiving dross into the conduit, and an outlet opening for discharging dross received through said inlet opening; and introducing in a gas-receiving opening below the outlet opening a gas which rises in said conduit to induce a flow of dross into said inlet opening and towards said outlet opening.

11. In a metal treating process in which a moving strip of metal passes through a bath of molten metal and a gas-filled housing which encloses the moving strip of metal, the housing having an opening in said bath of molten metal below the surface thereof, through which the strip of metal exits the housing while submerged in the molten bath of metal, a method for removing and diluting a layer of dross from the surface of the metal bath inside the gas-filled housing, comprising:

supporting a first conduit having an inlet opening adjacent the layer of dross for receiving dross into the first conduit, an outlet opening for discharging dross received through said inlet opening; and a first gas-receiving opening below the outlet opening thereof;

introducing a gas which tends to rise in said molten metal, into said first gas-receiving opening to induce a flow of dross into said inlet opening and towards said outlet opening as the gas rises in said first conduit;

supporting a second conduit having an inlet opening disposed in the bath of molten metal for receiving metal therein from the bath, an outlet opening for discharging metal received through the inlet opening to a location adjacent the layer of dross inside the gas-filled housing, and a second gas-receiving opening below the outlet opening thereof; and introducing a gas which tends to rise in said molten metal into said second gas-receiving opening to induce a flow of molten metal into the inlet opening of the second conduit and towards the outlet opening thereof as the gas rises in the second conduit.

* * * * *